US011537063B2

(12) United States Patent
Noh et al.

(10) Patent No.: US 11,537,063 B2
(45) Date of Patent: Dec. 27, 2022

(54) METHOD FOR DETERMINING THE CONNECTION STATUS OF A TONER REFILL DEVICE

(71) Applicant: Hewlett-Packard Development Company, L.P., Spring, TX (US)

(72) Inventors: Jin Woo Noh, Seongnam-si (KR); Young Kang Kong, Seongnam-si (KR); Su Yong Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/312,513

(22) PCT Filed: Dec. 20, 2019

(86) PCT No.: PCT/US2019/067896
§ 371 (c)(1),
(2) Date: Jun. 10, 2021

(87) PCT Pub. No.: WO2020/149984
PCT Pub. Date: Jul. 23, 2020

(65) Prior Publication Data

US 2022/0057728 A1 Feb. 24, 2022

(30) Foreign Application Priority Data

Jan. 16, 2019 (KR) ..... 10-2019-0005937

(51) Int. Cl.
*G03G 15/08* (2006.01)
*G03G 21/18* (2006.01)

(52) U.S. Cl.
CPC ..... *G03G 15/0863* (2013.01); *G03G 15/0865* (2013.01); *G03G 15/0867* (2013.01); *G03G 21/1878* (2013.01); *G03G 15/086* (2013.01); *G03G 15/0894* (2013.01); *G03G 21/1892* (2013.01); *G03G 2215/0685* (2013.01); *G03G 2215/0697* (2013.01)

(58) Field of Classification Search
CPC ..... G03G 15/0865; G03G 2221/1823; G03G 2215/0697; G03G 21/1878; G03G 21/1892; G03G 15/0894
See application file for complete search history.

(56) References Cited

U.S. PATENT DOCUMENTS 5,075,724 A 12/1991 Wada et al.
6,065,824 A 5/2000 Bullock et al.
(Continued)

FOREIGN PATENT DOCUMENTS

EP 0952496 A2 10/1999
EP 1 014 680 A2 6/2000
(Continued)

*Primary Examiner* — Jessica L Eley
(74) *Attorney, Agent, or Firm* — Jefferson IP Law, LLP

(57) ABSTRACT

An example image forming apparatus includes a printing engine to perform a printing work by using toner filled in a toner cartridge, a communication device to communicate with a circuit board attached to a toner refill apparatus that refills toner in the toner cartridge by using a plurality of terminals, and a processor to identify a connection state of the toner refill apparatus based on a voltage value of at least one of the plurality of terminals.

17 Claims, 16 Drawing Sheets

(56) References Cited

U.S. PATENT DOCUMENTS

| | | | | |
|---|---|---|---|---|
| 7,177,551 | B2 | 2/2007 | Eom et al. | |
| 9,227,417 | B2 | 1/2016 | Ignatchenko et al. | |
| 9,557,696 | B2 | 1/2017 | Eom et al. | |
| 2004/0046841 | A1 | 3/2004 | Cheok | |
| 2006/0279127 | A1 | 12/2006 | Cronin et al. | |
| 2009/0175632 | A1 | 7/2009 | Kim | |
| 2011/0320831 | A1* | 12/2011 | Inokuchi | G06F 1/30 713/300 |
| 2013/0343019 | A1 | 12/2013 | Amann et al. | |
| 2014/0270813 | A1* | 9/2014 | Ignatchenko | B41J 2/17546 399/27 |
| 2016/0226244 | A1* | 8/2016 | Tomida | H02J 7/00 |
| 2017/0060083 | A1* | 3/2017 | Hirayama | G03G 21/1652 |

FOREIGN PATENT DOCUMENTS

| | | | |
|---|---|---|---|
| JP | 6-149047 | A | 5/1994 |
| JP | 2005-301207 | A | 10/2005 |
| JP | 4205531 | B2 | 1/2009 |
| JP | 2010-217729 | A | 9/2010 |
| JP | 2014-69489 | A | 4/2014 |
| JP | 2018-180558 | A | 11/2018 |
| WO | 2011/155642 | A1 | 12/2011 |

* cited by examiner

FIG. 8B

| | FIRST STATE | SECOND STATE | THIRD STATE | FOURTH STATE | FIFTH STATE |
|---|---|---|---|---|---|
| R4 | 10K | 10K | 10K | 10K | 10K |
| R3 | | 20K | Short | Short | 20K |
| R2 | | 1K | 1K | Open | Open |
| R1 | | 5K | 5K | 5K | 5K |
| VOLTAGE VALUE | 3.3V | 2.23V | 0.25V | 1.1V | 2.36V |

FIG. 10B

| | FIRST STATE | SECOND STATE | THIRD STATE | FOURTH STATE | FIFTH STATE |
|---|---|---|---|---|---|
| R4 | 10K | 10K | 10K | 10K | 10K |
| R3 | | Short | 5K | 5K | Short |
| R2 | | 1K | 1K | Open | Open |
| R1 | | 20K | 20K | 20K | 20K |
| VOLTAGE VALUE | 3.3V | 0.29V | 1.23V | 2.36V | 2.2V |

FIG. 12B

| | FIRST STATE | SECOND STATE | THIRD STATE | FOURTH STATE | FIFTH STATE |
|---|---|---|---|---|---|
| R4 | 10K | 10K | 10K | 10K | 10K |
| R3 | | Open | 10K | 10K | Open |
| R2 | | Open | Open | 1K | 1K |
| R1 | | 20K | 20K | 20K | 20K |
| VOLTAGE VALUE | 3.3V | 2.2V | 1.32V | 0.26V | 0.28V |

METHOD FOR DETERMINING THE CONNECTION STATUS OF A TONER REFILL DEVICE

BACKGROUND

An image forming apparatus refers to an apparatus that prints printing data generated at a terminal apparatus like a computer on printing paper. An image forming apparatus may include a copier, a printer, a scanner, a facsimile, a multi-function printer (MFP) that integrally implements the functions of the aforementioned apparatuses through one apparatus, etc.

An image forming apparatus adopting a laser printing method uses toner to print an image. Toner is used every time an image forming job proceeds, and thus it becomes depleted when used for more than a certain amount of time.

BRIEF DESCRIPTION OF THE DRAWINGS

FIG. 8B is a table illustrating voltage values according to states of a toner refill apparatus according to an example;

FIG. 10B is a table illustrating voltage values according to the states of a toner refill apparatus according to an example;

FIG. 12B is a table illustrating voltage values according to the states of a toner refill apparatus according to an example.

DETAILED DESCRIPTION

Hereinafter, various examples of the disclosure will be described with reference to the accompanying drawings. The examples described below may be modified into several different forms. Also, with respect to matters that are widely known to those of ordinary skill in the art to which the following examples belong, a detailed explanation will be omitted, for explaining the characteristics of the examples more clearly.

A description that one element is "connected to" another element should be interpreted to include both the case where the one element is directly connected to the other element, and the case where the one element is connected to the other element through still another element. Also, the description in this specification that one element "includes" another element can be interpreted to mean that other elements may additionally be included, but not that other elements are excluded, unless there is any specific description meaning the contrary.

In this specification, the term "image forming job" may refer to any of various kinds of jobs (e.g., printing, copying, scanning, or faxing) related to an image such as formation of an image or generation/storing/transmission of an image file, etc. Also, the term "job" may not only refer to an image forming job, but also include any process necessary for performing an image forming job.

In addition, the term "image forming apparatus" may refer to an apparatus that prints printing data generated at a terminal apparatus like a computer on a recording medium such as paper. An image forming apparatus may include a copier, a printer, a scanner, a facsimile, a multi-function printer (MFP) that integrally implements the functions of the aforementioned apparatuses through one apparatus, etc. Also, an image forming apparatus may refer to any apparatus that is capable of performing an image forming job such as a copier, a printer, a scanner, a fax machine, an MFP, a display apparatus, etc.

Further, the term "hard copy" may refer to an operation of printing an image on a printing medium such as paper, and the term "soft copy" may refer to an operation of printing an image on a display apparatus such as a TV, a monitor, etc., or an operation of saving an image to a memory.

Also, the term "contents" may refer to any kind of data that is the subject of an image forming job, such as a photograph, an image, a document file, etc.

In addition, the term "printing data" may refer to data converted into a printable format at a printer. If a printer supports direct printing, a file itself may be printing data.

Also, the term "user" may refer to a person who performs an operation related to an image forming job by using an image forming apparatus, or a device connected to an image forming apparatus through a wired or wireless connection. The term "manager" may refer to a person who has authority to access all functions and the system of an image forming apparatus. A "manager" and a "user" may be the same person.

Figure 1:
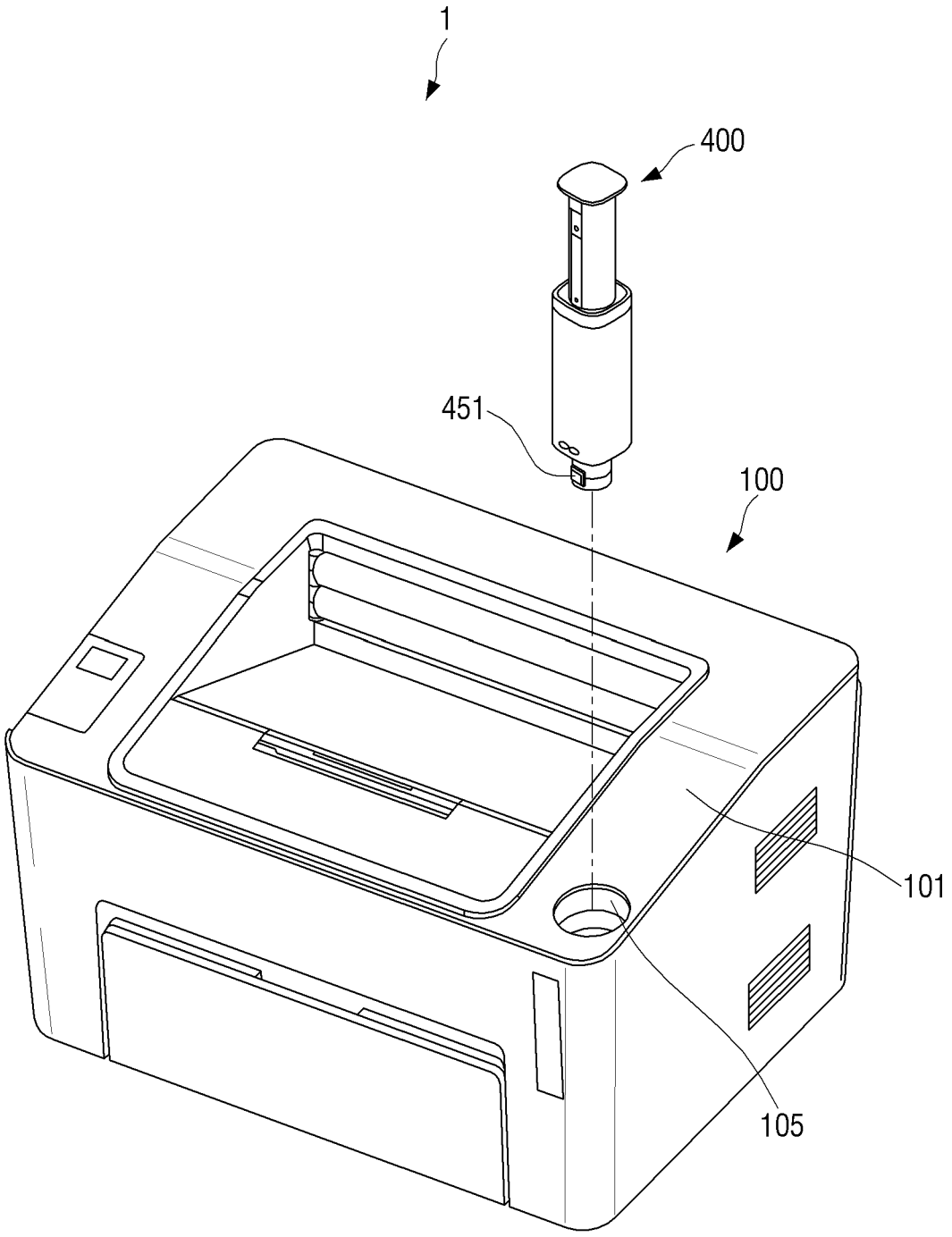
FIG. 1 is a schematic perspective view of an image forming apparatus according to an example.

FIG. 1 is a schematic perspective view of an image forming apparatus according to an example.

Referring to FIG. 1, an image forming apparatus 100 may perform a printing job by using toner.

The image forming apparatus 100 may receive refill of toner by using a toner refill apparatus 400. Here, the image forming apparatus 100 may identify whether the toner refill apparatus 400 is connected to the image forming apparatus 100, and whether the toner refill apparatus 400 is available.

On a main body 101 of the image forming apparatus 100, a pass-through groove 105, through which the toner refill apparatus 400 can be connected to a toner cartridge (not shown) that is mounted within the main body 101, may be formed. The pass-through groove 105 may be formed such that the toner refill apparatus 400 can be connected to the toner cartridge from the outside of the main body 101.

Examples of components and operations of the image forming apparatus 100 will be described later with reference to FIGS. 2 and 3.

The toner refill apparatus 400 is an apparatus that provides toner to the image forming apparatus 100. The toner refill apparatus 400 may include fourth terminals 451. In an example, the fourth terminals 451 are located on a front end of the toner refill apparatus 400 that is inserted into the pass-through groove 105.

The toner refill apparatus 400 may be electrically connected to the image forming apparatus 100 through the fourth terminals 451. The image forming apparatus 100 may detect the connection state of the toner refill apparatus 400 connected to the image forming apparatus 100 through the fourth terminals 451.

An image forming system 1 according to the above described example is capable of refilling toner to the image forming apparatus 100 by using the toner refill apparatus 400.

An example configuration of the toner refill apparatus 400 will be described later with reference to FIG. 5.

Figure 2:
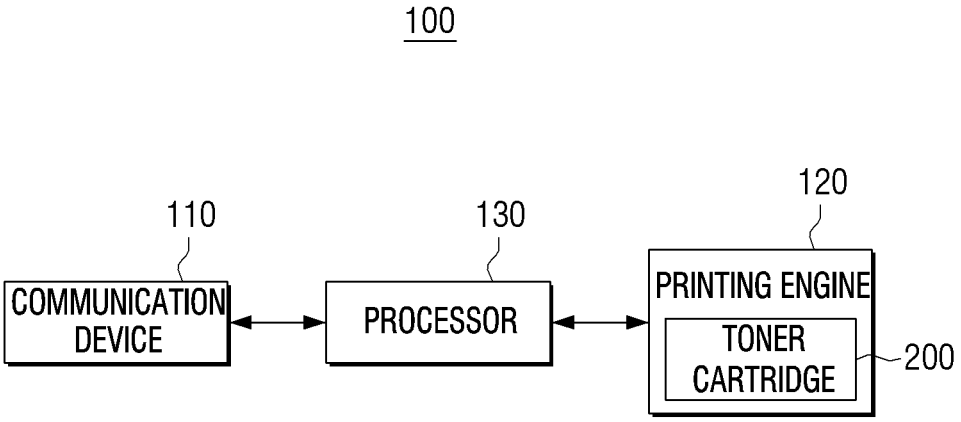
FIG. 2 is a block diagram illustrating a schematic configuration of the image forming apparatus in FIG. 1 according to an example.

FIG. 2 is a block diagram illustrating a schematic configuration of the image forming apparatus in FIG. 1 according to an example.

Referring to FIG. 2, an image forming apparatus 100 may include a communication device 110, a printing engine 120, and a processor 130. The printing engine 120 may include a toner cartridge 200.

The communication device 110 may be connected to a printing control terminal apparatus (not shown), and may receive printing data from the printing control terminal apparatus. As an example, the communication device 110 may be formed to connect the image forming apparatus 100 to an external apparatus through a local area network (LAN), an Internet network, or the like, but also through a universal serial bus (USB) port, a wireless communication (e.g., WiFi 802.11a/b/g/n, near field communication (NFC), Bluetooth) port, or the like. The communication device 110 as described above may also be referred to as a transceiver.

In a case in which the toner refill apparatus 400 is connected to the toner cartridge 200, the communication device 110 may perform communication with the toner refill apparatus 400 through the fourth terminals 451 formed on the toner refill apparatus 400.

Further, in a case in which the toner refill apparatus 400 is connected to the toner cartridge 200, the communication device 110 may include a plurality of first terminals 151*a*, 151*b*, 151*c* (refer to FIG. 7) that are electrically connected to the toner cartridge 200. The plurality of first terminals 151 may be electrically connected to the fourth terminals 451*a*, 451*b*, 451*c* (refer to FIG. 7) formed on the toner refill apparatus 400 through second terminals 251*a*, 251*b*, 251*c* (refer to FIG. 7) and third terminals 261*a*, 261*b*, 261*c* (refer to FIG. 7) formed on the toner cartridge 200.

An example of a connection between the toner refill apparatus 400 and the image forming apparatus 100 using a plurality of terminals will be described later with reference to FIG. 7.

The printing engine 120 forms an image. As an example, the printing engine 120 may form an image on an image forming medium on which an image is formed, such as a photosensitive drum, an intermediate transcription belt, a paper transfer belt, or the like.

The printing engine 120 may include various consumable devices that are directly or indirectly involved in a printing job. For example, in the case of a laser image forming apparatus, a charging device, an exposure device, a development device, a transcription device, a fusing device, various rollers, a belt, an organic photoconductor (OPC) drum, etc. may become consumable devices. Also, various types of devices which are required to be replaced, such as a toner cartridge that may perform a function of a development device, may be defined as consumable devices for use in an image forming apparatus. Example components and operations of the printing engine 120 will be described later with reference to FIG. 3.

The processor 130 may control one or more component inside the image forming apparatus 100. As an example, when the processor 130 receives printing data from a printing control terminal apparatus (not shown), the processor 130 may control the printing engine 120 so that the received printing data is printed. Here, a printing control terminal apparatus may include an electronic apparatus that provides printing data, and it may be a personal computer (PC), a laptop computer, a tablet PC, a smartphone, a server, etc.

If the amount of toner of the toner cartridge 200 becomes lower than a specific amount, and it is identified that refill of toner of the toner cartridge 200 is necessary, the image forming apparatus 100 may notify information in this regard to a management server (not shown) or a manager (e.g., a terminal apparatus of a manager).

In a case in which the toner refill apparatus 400 is connected to the image forming apparatus 100, the processor 130 may identify whether the toner refill apparatus 400 is connected to the image forming apparatus 100 (e.g., whether the toner refill apparatus 400 is connected to the toner cartridge 200). For example, if connection with the fourth terminals 451 of the toner refill apparatus 400 is identified, the processor 130 may identify that the toner refill apparatus 400 has been connected.

Further, the processor 130 may identify the connection state of the toner refill apparatus 400 based on a voltage value of at least one of a plurality of terminals.

As an example, in a case in which the identified voltage value is a first voltage value, the processor 130 may identify that it is a first state wherein the toner refill apparatus 400 is not connected. In a case in which the identified voltage value is changed from a first voltage value to a second voltage value, the processor 130 may identify that it is a second state wherein the toner refill apparatus 400 is connected.

If the toner refill apparatus 400 is connected, the processor 130 may identify whether toner refill apparatus 400 is available, based on the information stored in a circuit board 453 (refer to FIG. 5) of the toner refill apparatus 400.

As an example, information on availability of the toner refill apparatus 400 may include information on whether the toner refill apparatus 400 is an apparatus that matches authentication information of the image forming apparatus 100 and information on whether the toner refill apparatus 400 is a used toner refill apparatus 400.

In a case in which the identified voltage value is a second voltage value, the processor 130 may identify that the toner refill apparatus 400 is an available apparatus. Also, the processor 130 may identify whether the toner refill apparatus 400 is an available apparatus at the same time as whether the toner refill apparatus 400 is connected. If the toner refill apparatus 400 is identified as an available apparatus, the processor 130 may control the toner cartridge 200 such that the toner of the toner refill apparatus 400 is infiltrated into the toner cartridge 200. As an example, the processor 130 may control such that the toner cartridge 200 is rotatively driven by rotating a component of the toner refill apparatus 400, for opening an outlet 401 (refer to FIG. 5) of the toner refill apparatus 400 that will be described later.

In a case in which the identified voltage value is a third voltage value, the processor 130 may identify that it is a third state wherein the outlet 401 (refer to FIG. 5) of the toner refill apparatus 400 is opened.

When the outlet 401 of the toner refill apparatus 400 is opened, the toner of the toner refill apparatus 400 may be refilled in the toner cartridge 200.

In a case in which the identified voltage value is a fourth voltage value, the processor 130 may identify that it is a fourth state wherein the opened toner refill apparatus 400 completed refilling toner to the toner cartridge 200.

In a case in which the identified voltage value is a fifth voltage value, the processor 130 may identify that the connected toner refill apparatus 400 is an apparatus that is not available. For example, in order to prevent reuse of the toner refill apparatus 400, in a case in which the toner refill apparatus 400 has already been used, a fifth voltage value may be measured when the toner refill apparatus 400 is connected to the image forming apparatus 100.

If it is identified that the toner refill apparatus 400 is not available, the processor 130 may notify information in this regard to a management server (not shown) or a manager (e.g., a terminal apparatus of a manager).

The processor 130 may identify the state of the toner refill apparatus 400 as one of the first state, the second state, the third state, the fourth state, and the fifth state based on the identified voltage value. However, the voltage value is not limited to the aforementioned voltage values, and different values may be used depending on manners of implementation.

A first voltage value, a second voltage value, a third voltage value, a fourth voltage value, and a fifth voltage value may be set such that they are different values from one another, and each of the voltage values has a range that is distanced from one another. As division of voltage values representing each state is clear as above, each state of the toner refill apparatus can be clearly distinguished.

While an example is described in which the processor 130 may identify a state of the toner refill apparatus 400 as one of the first to the fifth state, the disclosure is not limited thereto in that the processor 130 may identify various states of the toner refill apparatus 400. As an example, the processor 130 may identify a state as one of the first to fourth states.

Example components constituting an image forming apparatus have been illustrated and described. However, in other example implementations, various components may additionally be included.

Figure 3:
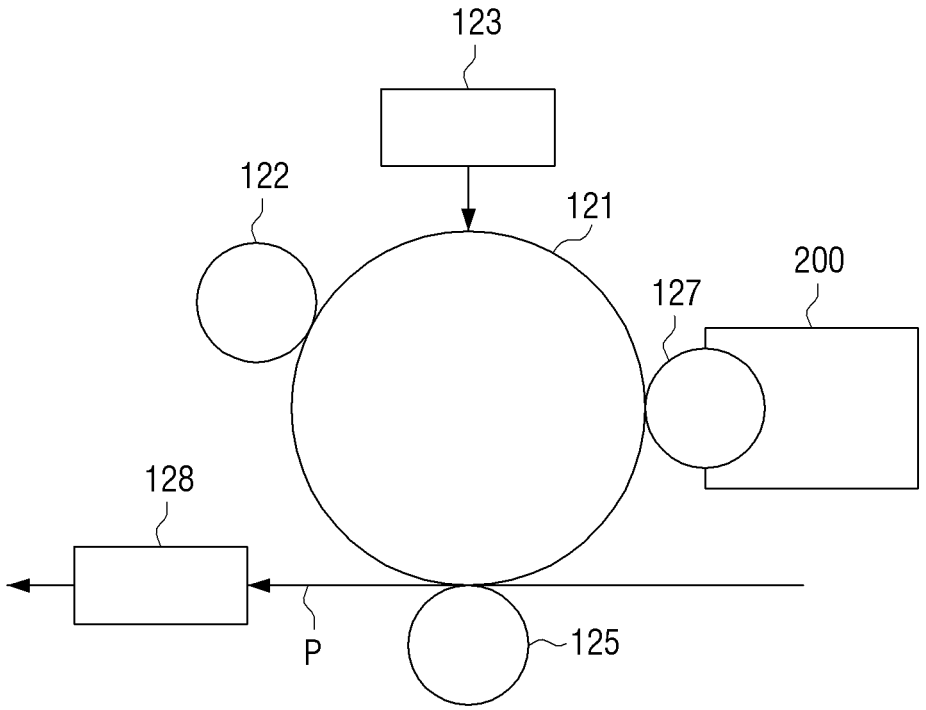
FIG. 3 is a diagram illustrating a configuration of the printing engine in FIG. 2 according to an example.

FIG. 3 is a diagram illustrating a configuration of the printing engine in FIG. 2 according to an example.

Referring to FIG. 3, a printing engine may include a photosensitive drum 121, a charging device 122, an exposure device 123, a toner cartridge 200, a transcription device 125, and a fusing device 128.

On the photosensitive drum 121, an electrostatic latent image is formed. The photosensitive drum 121 may be referred to as a photosensitive drum, a photosensitive belt, etc., according to its shape.

The charging device 122 charges the surface of the photosensitive drum 121 with a homogenous potential. The charging device 122 may be implemented as a corona charging device, a charging roller, a charging brush, etc.

The exposure device 123 changes the surface potential of the photosensitive drum 121 according to information on the image to be printed, and thereby forms an electrostatic latent image on the surface of the photosensitive drum 121.

The toner cartridge 200 accommodates toner and develops an electrostatic latent image into a visible image by providing toner to the electrostatic latent image formed on the photosensitive drum 121. The toner cartridge 200 may include a developing roller 127 that provides toner to the electrostatic latent image. An example of a shape and components of the toner cartridge 200 will be described later with reference to FIG. 4.

A visual image formed on the photosensitive drum 121 is transcribed to a recording medium P by the transcription device 125 or an intermediate transcription belt (not shown).

The fusing device 128 fuses the visible image on the recording medium P by applying heat or pressure to the visual image on the recording medium P. By a series of processes as described above, a printing job is completed.

The toner as described above is used every time an image forming job proceeds, and is depleted when used for more than a certain number of times. Because a toner cartridge includes various components, it would be cost effective to refill the toner without replacing the toner cartridge. Accordingly, examples of a toner cartridge which is capable of refilling toner and an apparatus that refills toner to a toner cartridge will be described later with reference to FIGS. 4 and 5, respectively.

Figure 4:
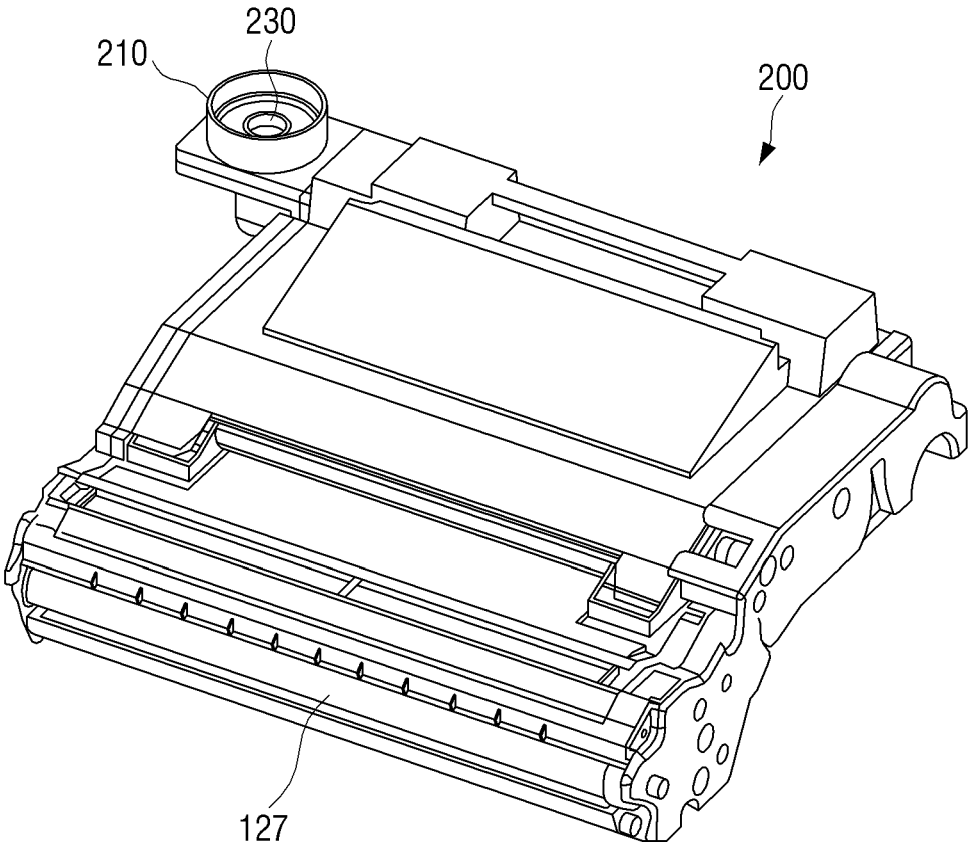
FIG. 4 is a perspective view of a toner cartridge according to an example.

FIG. 4 is a perspective view of a toner cartridge according to an example.

Referring to FIG. 4, in the inside of a toner cartridge 200, a toner accommodating part (not shown) to include toner may be formed.

On the toner cartridge 200, a toner charging device 210 which is a channel for being provided with toner from the toner refill apparatus 400 may be formed. The toner charging device 210 may be formed to be connected to the pass-through groove 105 in upper and lower directions.

The toner refill apparatus 400 may be coupled to the toner charging device 210 of the toner cartridge 200 through the pass-through groove 105 from the upper direction of the main body 101. The toner charging device 210 may be formed such that the toner refill apparatus 400 can be connected to the toner cartridge 200 mounted on the main body 101 through the pass-through groove 105 from the outside of the main body 101.

On the toner charging device 210, a hole 230 for receiving refill of toner may be formed. In the lower part of the toner charging device 210 or in the middle position of the toner charging device 210, a locking member (not shown) that electrically opens and closes the hole 230 may be disposed. Here, the locking member (not shown) may be an apparatus that opens and closes the hole 230 according to an electric signal, and it may be driven by an apparatus such as a solenoid, etc.

Accordingly, the toner cartridge 200 may be selectively infiltrated with toner of the toner refill apparatus 400 when the toner refill apparatus 400 is normally connected and is authenticated.

The toner cartridge 200 may include a sensor (not shown) for detecting an amount of toner within the toner cartridge 200. By using such a sensor (not shown), the amount of toner inside the toner cartridge 200 may be identified, and also, it may be identified whether toner was normally infiltrated through a toner refill process, etc.

The toner cartridge 200 may include second terminals 251*a*, 251*b*, 251*c* (refer to FIG. 7) for being electrically connected to the image forming apparatus 100, and third terminals 261*a*, 261*b*, 261*c* (refer to FIG. 7) for being electrically connected to the toner refill apparatus 400.

The second terminals 251*a*, 251*b*, 251*c* may be electrically connected to the first terminals 151*a*, 151*b*, 151*c* (refer to FIG. 7) inside the image forming apparatus 100, when the toner cartridge 200 is mounted on the image forming apparatus 100. Here, the second terminals 251*a*, 251*b*, 251*c* may transmit and receive not only signals for communication between the image forming apparatus 100 and the toner cartridge 200, but also signals for communication with a customer replaceable unit monitor (CRUM) apparatus attached to the toner cartridge 200 or the toner refill apparatus 400.

The third terminals 261*a*, 261*b*, 261*c* may be electrically connected to the fourth terminals 451*a*, 451*b*, 451*c* (refer to FIG. 5) of the toner refill apparatus 400, when the toner refill apparatus 400 is connected to the toner charging device 210 for refill. Here, the third terminals 261*a*, 261*b*, 261*c* may transmit and receive signals between the image forming apparatus 100 and the circuit board 453.

An example of a form of a connection between the second terminals 251*a*, 251*b*, 251*c* and the third terminals 261*a*, 261*b*, 261*c* will be described later with reference to FIG. 7.

Figure 5:
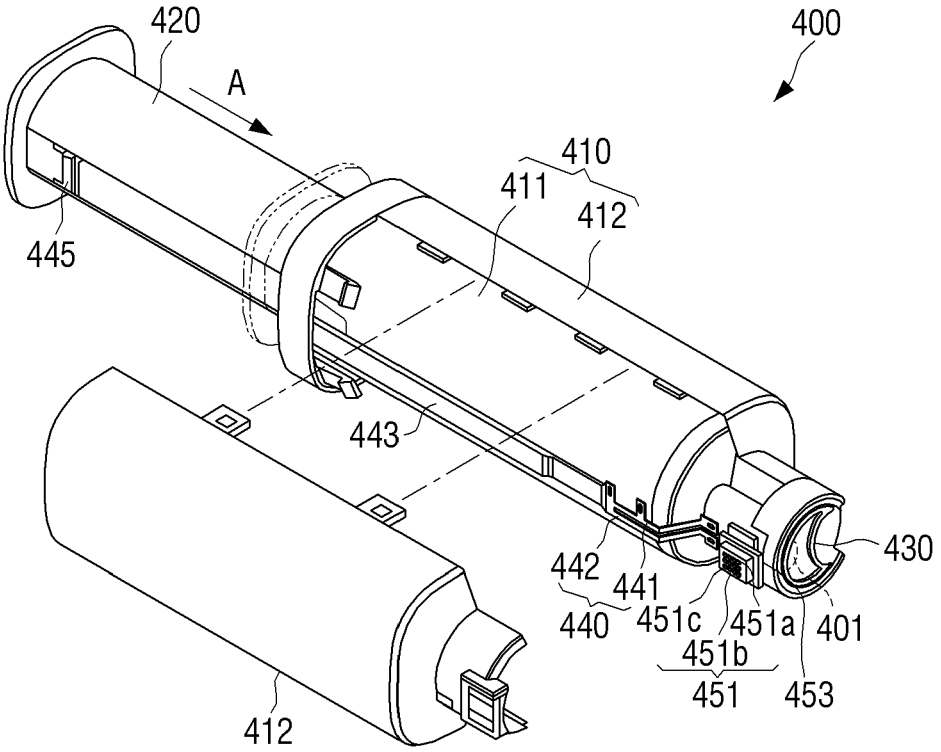
FIG. 5 is a partial exploded perspective view of a toner refill apparatus according to an example.

FIG. 5 is a partial exploded perspective view of a toner refill apparatus according to an example.

Referring to FIG. 5, the toner refill apparatus 400 may be formed as a syringe type including a body 410 which accommodates toner in its inside and includes a toner outlet 401, and a plunger 420 which is movably coupled to the body 410 in a longitudinal direction A and pushes toner outside the body 410.

The toner outlet 401 may be provided on the front end of the body 410. A discharge shutter 430 may selectively open and close the toner outlet 401.

The body 410 may include an inner body 411 to accommodate toner, and an outer body 412 disposed on the outside of the inner body 411.

The plunger 420 may be inserted into the inner body 411 and move in the longitudinal direction A.

The toner outlet 401 may be connected to the inner body 411.

The discharge shutter 430 may be installed such that it can independently rotate with respect to the front end of the body 410. For example, as illustrated in FIG. 5, the discharge shutter 430 may be disposed in a closed position blocking the toner outlet 401. Also, the discharge shutter 430 may be disposed in a discharge position wherein the discharge shutter 430 rotates with respect to the body 410 and opens the toner outlet 401. Further, the discharge shutter 430 may rotate with respect to the center axis of the toner refill apparatus 400 by rotation of the toner cartridge 200. In an example, the discharge shutter 430 rotates by 180 degrees.

The toner refill apparatus 400 may include the circuit board 453 for managing information of the toner refill apparatus 400, and fourth terminals 451 (i.e., 451*a*, 451*b*, and 451*c*) for connection with the main body 101. The circuit board 453 and the fourth terminals 451 may be provided on the front end of the body 410.

When the toner refill apparatus 400 is mounted on the toner cartridge 200, the fourth terminals 451*a*, 451*b*, 451*c* may be electrically connected to the third terminals 261*a*, 261*b*, 261*c* of the toner cartridge 200, and transmit the information and state of the toner refill apparatus 400 to the main body 101 of the image forming apparatus 100 through the toner cartridge 200.

The circuit board 453 may be a CRUM part that includes a processor performing at least one of authentication or encrypted data communication with the main body 101.

The circuit board 453 may further include a memory. The memory may store various types of information regarding the toner refill apparatus 400. For example, the memory may store information on a manufacturer, information on a manufacturing date, unique information such as a serial number, a model name, etc., information on various programs and an electronic signature and information on a state of use (e.g., how many sheets have been printed so far, how many remaining sheets that are printable exist, a remaining amount of toner, etc.). In addition, the memory may store information on the life, the set-up menus, etc. of the toner refill apparatus 400.

The circuit board 453 may include function blocks that are capable of performing various functions for communication, authentication, encryption, etc. with the main body 101. The circuit board 453 may be implemented in the form of a chip including a processor or memory, or in the form of a printed circuit board assembly (PBA) on which a chip and circuit elements for implementing various function blocks are mounted.

The fourth terminals 451*a*, 451*b*, 451*c* may have various forms which enable electrical connection with the main body 101, such as a form of a conductive pattern, a form of a modular jack, a form of an elastic terminal, etc. The fourth terminals 451 in this example illustrated in FIG. 5 are conductive patterns. The fourth terminals 451 may be formed to be exposed to the outside of the body 410.

The fourth terminals 451 may comprise terminals that become three electrical contacts. As an example, the fourth terminals 451*a*, 451*b*, 451*c* may comprise a fourth data terminal 451*a*, a fourth ground terminal 451*b*, and a fourth state terminal 451*c*.

The fourth data terminal 451*a* may be for transmitting information stored in the memory of the circuit board 453 to the main body 101 of the image forming apparatus 100.

The fourth state terminal 451*c* may be for transmitting signals regarding whether the toner refill apparatus 400 is mounted on the toner cartridge 200, and whether the refill operation of the toner refill apparatus 400 has been completed to the main body 101 of the image forming apparatus 100.

As an example, when the toner refill apparatus 400 is mounted on the main body 101, a closed circuit may be formed by a first resistance R1 (refer to FIG. 7) disposed between the fourth ground terminal 451*b* and the fourth state terminal 451*c*, and thus it can be identified whether the toner refill apparatus 400 is mounted on the toner cartridge 200.

In a case in which it is the second state wherein the toner refill apparatus 400 is mounted on the toner cartridge 200, a voltage value between the first state terminal 151*c* and the first ground terminal 151*b* is changed by a circuit including the first resistance R1 of the toner refill apparatus 400. Accordingly, the processor 130 may identify whether the toner refill apparatus 400 is connected.

The toner refill apparatus 400 may include a second resistance R2 (refer to FIG. 7) and a fuse 440 for identifying whether the toner refill apparatus 400 has completed a refill operation.

The toner refill apparatus 400 may include the second resistance R2 (refer to FIG. 7) that is connected in parallel with the first resistance R1. The second resistance R2 may be disposed between the fourth ground terminal 451*b* and the fourth state terminal 451*c*.

The toner refill apparatus 400 may include the second resistance R2 of which one end is commonly connected to one end of the first resistance R1 and the fourth ground terminal 451*b*, and the fuse 440 of which one end is connected to the other end of the second resistance R2, and of which the other end is connected to the fourth state terminal 451*c*.

The fuse 440 may be formed to be opened when a refill operation of the toner refill apparatus 400 is completed. As the second resistance R2 disposed in parallel with the first resistance R1 is removed by opening of the fuse 440, it can be identified whether the toner refill apparatus 400 has completed the refill operation.

As an example, in a case in which the refill operation of the toner refill apparatus 400 has been completed, the second resistance R2 may be removed by opening of the fuse 440, and accordingly, a voltage value between the first state terminal 151*c* and the first ground terminal 151*b* of the main body 101 is changed. Thus, it can be identified whether the toner refill apparatus 400 has completed the refill operation.

The fuse 440 may include a pair of electrodes 441, 442 that are provided on the outer body 412 and the inner body 411. The pair of electrodes 441, 442 may be respectively connected to the fourth state terminal 451*c*. The state of electrical contact of the pair of electrodes 441, 442 may vary according to the position of the plunger 420. The state of electrical contact of the pair of electrodes 441, 442 may become an open state when the plunger 420 reaches a position wherein refill of toner is completed. The open state of the pair of electrodes 441, 442 will stop a current from flowing.

For changing the state of electrical contact of the pair of electrodes 441, 442, an operation lever 443 that is movable in the longitudinal direction A between the outer body 412 and the inner body 411 may be provided. On the plunger 420, a pressing projection 445 that makes the pair of electrodes 441, 442 distanced from each other by pushing the operation lever 443 when a refill operation has been completed may be provided.

When infiltration of toner by the toner refill apparatus 400 is completed, the pressing projection 445 may release the connection between the pair of electrodes 441, 442 by pushing the operation lever 443 according to use of the plunger 420 in the longitudinal direction A.

In the example of FIG. 5, it is illustrated that the fuse 440 includes the pair of electrodes 441, 442. However, this is merely an example and the fuse 440 may be formed in various shapes such that the shape of the fuse 440 is damaged as it melts or is broken when infiltration of toner by the toner refill apparatus 400 is completed, and is not restored again.

The toner refill apparatus 400 may prevent illegal reuse of the toner refill apparatus 400 by the fuse 440 that is damaged when infiltration of toner is completed.

Figure 6A:
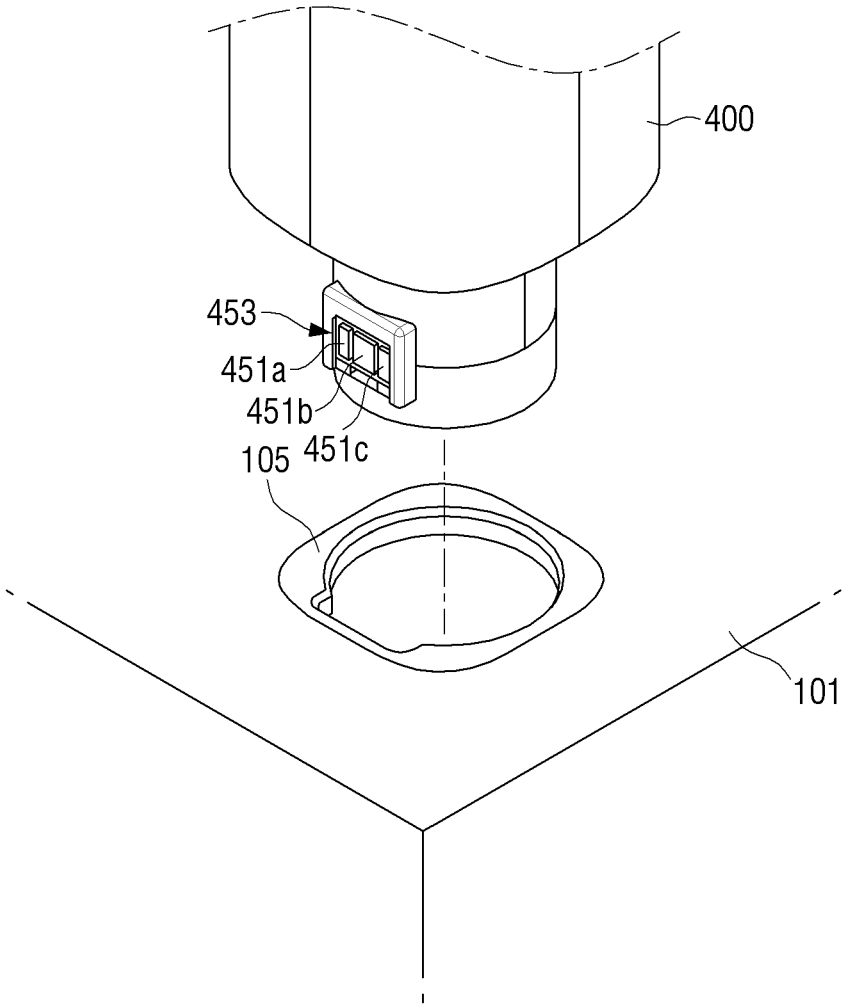
FIGS. 6A and 6B are diagrams for illustrating a toner refill apparatus that is connected to a toner cartridge through a pass-through part from an exterior of a main body of an image forming apparatus according to an example.
Figure 6B:
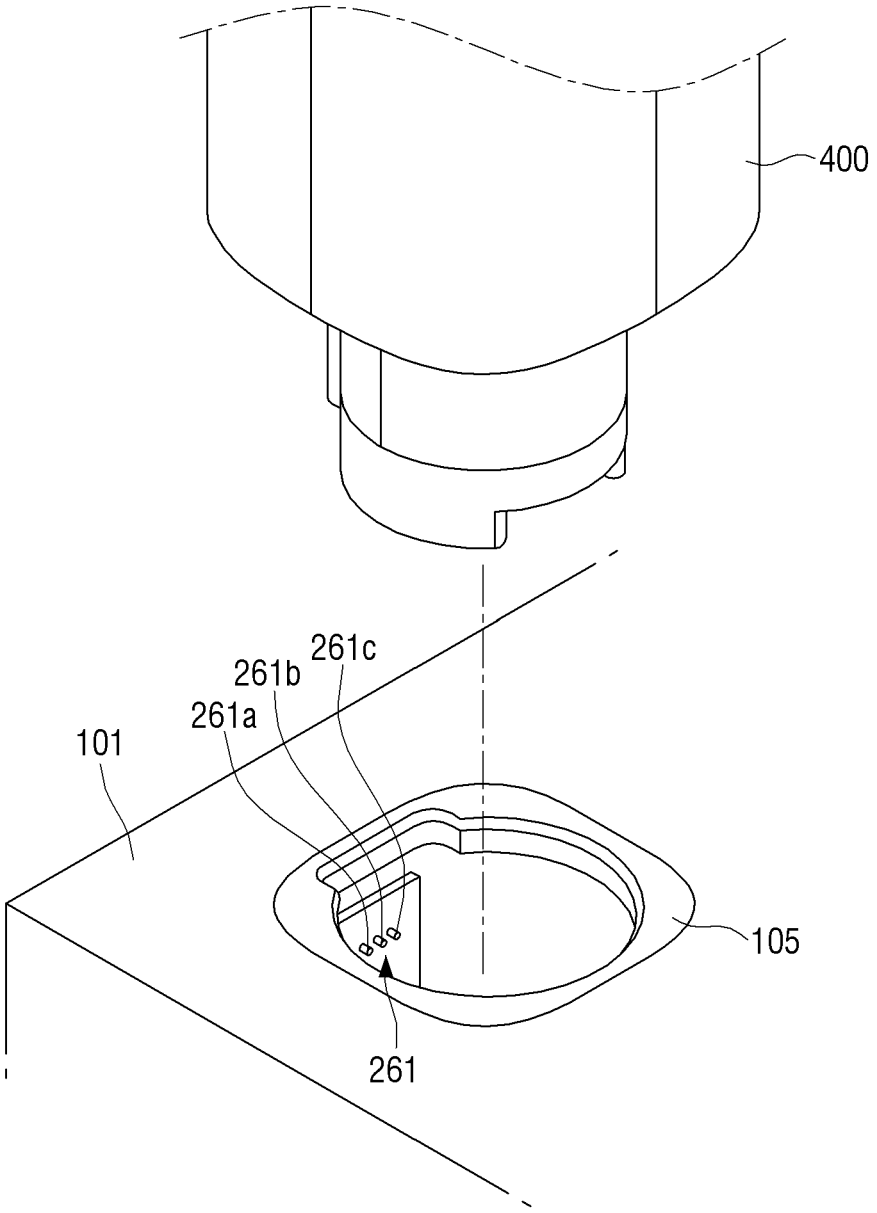

FIGS. 6A and 6B are diagrams for illustrating a toner refill apparatus that is connected to a toner cartridge through a pass-through part from an exterior of a main body of an image forming apparatus according to an example.

Referring to FIGS. 6A and 6B, the toner refill apparatus 400 may be mounted on the toner cartridge 200 through the pass-through groove 105 from the exterior of the main body 101 of the image forming apparatus 100. FIG. 6A illustrates a view of the toner refill apparatus 400 from a front side when the toner refill apparatus 400 is coupled to the pass-through groove 105. FIG. 6B illustrates a view of the toner refill apparatus 400 from a rear side when the toner refill apparatus 400 is coupled to the pass-through groove 105.

When the toner refill apparatus 400 is inserted into the pass-through groove 105 from the upper direction of the main body 101, the toner refill apparatus 400 may be mounted on the toner cartridge 200.

When the toner refill apparatus 400 is mounted on the toner cartridge 200 of the image forming apparatus, the fourth terminals 451*a*, 451*b*, 451*c* of the toner refill apparatus 400 may be electrically connected to the third terminals 261*a*, 261*b*, 261*c* disposed in the toner cartridge 200.

The fourth terminals 451*a*, 451*b*, 451*c* of the toner refill apparatus 400 may be electrically connected to the first terminals 151 of the main body 101 through the third terminals 261*a*, 261*b*, 261*c* and the second terminals 251*a*, 251*b*, 251*c* provided on the toner cartridge 200. Accordingly, the toner refill apparatus 400 may be electrically connected to the main body 101 through the toner cartridge 200.

When the toner refill apparatus 400 is mounted on the toner cartridge 200, the third terminals 261*a*, 261*b*, 261*c* may be directly connected to the fourth terminals 451*a*, 451*b*, 451*c* of the toner refill apparatus 400. The third terminals 261*a*, 261*b*, 261*c* may be connected to the second terminals 251*a*, 251*b*, 251*c* through a flexible cable, and the second terminals 251*a*, 251*b*, 251*c* may be electrically connected to the first terminals 151*a*, 151*b*, 151*c* provided on the main body 101.

While the toner refill apparatus 400 is mounted on the toner cartridge 200, the discharge shutter 430 of the toner refill apparatus 400 may be rotated by the toner charging device 210 of the toner cartridge 200. By rotation, the discharge shutter 430 may be disposed in a discharge position that opens the toner outlet 401 from a close position.

While the toner outlet 401 of the toner refill apparatus 400 is opened, if the plunger 420 of the toner refill apparatus 400 is pressed in the longitudinal direction A of the body 410, the toner accommodated in the body 410 may be discharged through the toner outlet 401, and provided to the toner accommodating part of the toner cartridge 200. The toner refill apparatus 400 may be removed from the pass-through groove 105 after infiltration of toner is completed.

Figure 7:
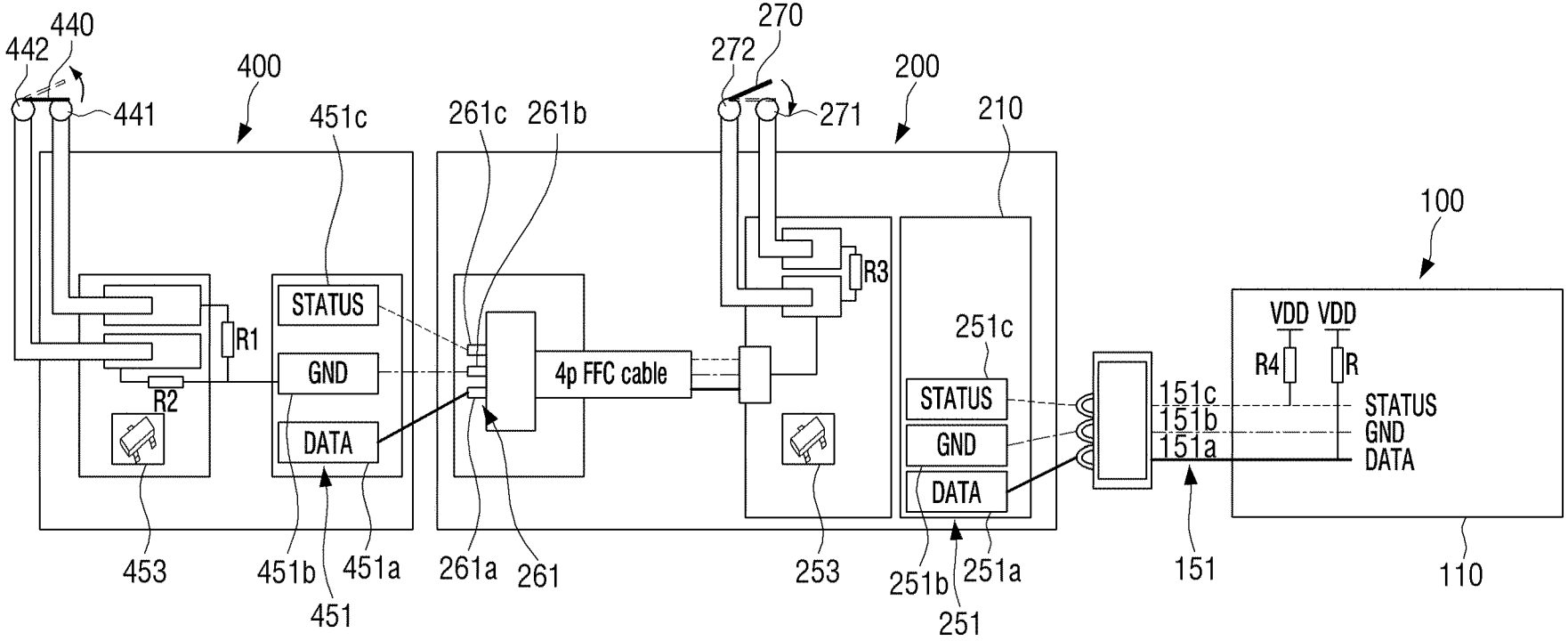
FIG. 7 is a diagram for illustrating a connection structure among a toner refill apparatus, a toner cartridge, and a main body according to an example.

FIG. 7 is a diagram for illustrating a connection structure among a toner refill apparatus, a toner cartridge, and a main body according to an example.

Referring to FIG. 7, the toner cartridge 200 and the toner refill apparatus 400 are consumable components that can be attached to or detached from the image forming apparatus 100, and the toner charging device 210 formed on the toner cartridge 200 may connect the toner cartridge 200 and the toner refill apparatus 400 to the main body of the image forming apparatus 100.

The image forming apparatus 100 may include the main body 101, the toner cartridge 200 that can be attached to or detached from the main body 101, and the toner refill apparatus 400 on which the toner cartridge 200 can be mounted.

The toner cartridge 200 forms a toner image by providing toner to an electrostatic latent image formed on a photosensitive member, and the toner cartridge 200 may be attached to or detached from the main body of the image forming apparatus 100.

The communication device 110 of the image forming apparatus 100 may include the first terminals 151 that are electrically connected to the toner cartridge 200. As an example, the first terminals 151 may comprise the first data terminal 151*a*, the first ground terminal 151*b*, and the first state terminal 151*c*. The first terminals 151 may be electrically connected to the second terminals 251*a*, 251*b*, 251*c* of the toner cartridge 200 mounted on the main body 101.

The communication device 110 may further include a fourth resistance R4 formed on the first state terminal 151*c* to which a reference voltage (VDD) is applied.

On the toner cartridge 200, the toner refill apparatus 400 for charging toner in the toner cartridge 200 may be mounted.

The processor 130 may control operations of the image forming apparatus 100 based on connection with the toner cartridge 200 mounted on the main body 101, and the toner refill apparatus 400 mounted on the toner cartridge 200.

The toner cartridge 200 may connect the toner refill apparatus 400 mounted on the toner cartridge 200 to the main body 101 through an identical interface to the toner cartridge 200 mounted on the main body 101.

The toner cartridge 200 may include the second terminals 251 that are electrically connected to the communication device 110 provided on the main body 101, and the third terminals 261 that are electrically connected to the toner refill apparatus 400 mounted on the toner cartridge 200.

The toner cartridge 200 may include a circuit board 253 that manages information on the toner cartridge 200, and may transmit information on the state of the toner refill apparatus 400 acquired through the third terminals 261*a*, 261*b*, 261*c*, and information on the toner refill apparatus 400 acquired from the circuit board 453 to the communication device 110.

As an example, the second terminals 251 may include the second data terminal 251*a*, the second ground terminal 251*b*, and the second state terminal 251*c*. When the toner cartridge 200 is mounted on the main body 101, the first data terminal 151*a* is electrically connected to the second data terminal 251*a*, the first ground terminal 151*b* is electrically connected to the second ground terminal 251*b*, and the first state terminal 151*c* is electrically connected to the second state terminal 251*c*.

The second terminals 251*a*, 251*b*, 251*c* and the third terminals 261*a*, 261*b*, 261*c* may be connected through a flexible flat cable. For example, the second terminals 251*a*, 251*b*, 251*c* provided in the lower part of the toner cartridge 200 may be electrically connected to the third terminals 261*a*, 261*b*, 261*c* provided on the toner charging device 210 of the toner cartridge 200.

Accordingly, a stable electrical connection between the second terminals 251*a*, 251*b*, 251*c* and the third terminals 261*a*, 261*b*, 261*c* can be maintained. Also, the second terminals 251*a*, 251*b*, 251*c* and the third terminals 261*a*, 261*b*, 261*c* connected through the flexible flat cable may be constituted in the form of one assembly, and provided on the toner cartridge 200.

The third terminals 261*a*, 261*b*, 261*c* may comprise a plurality of terminals which are three electrical contacts. Each of the three electrical contacts of the second terminals 251*a*, 251*b*, 251*c* may be electrically connected to each of the three electrical contacts of the third terminals 261*a*, 261*b*, 261*c*, respectively, by a flexible cable.

As a result, when the toner refill apparatus 400 is mounted on the toner cartridge 200, the second terminals 251*a*, 251*b*, 251*c* may be electrically connected to the fourth terminals 451*a*, 451*b*, 451*c*, respectively, of the toner refill apparatus 400 through the third terminals 261*a*, 261*b*, 261*c* of the toner cartridge 200.

The circuit board 253 may be disposed on a surface that is opposite to a contact surface on which the second terminals 251*a*, 251*b*, 251*c* that are electrically connected to the main body 101 are formed. Each of a plurality of electrical contacts provided on the second terminals 251*a*, 251*b*, 251*c* may respectively be connected to each of a plurality of electrical contacts provided on the third terminals 261*a*, 261*b*, 261*c* in a corresponding manner.

The toner cartridge 200 may include a third resistance R3 that is disposed between the second state terminal 251*c* and the third state terminal 261*c*, and a switch 270 that is disposed in parallel with the third resistance R3. The switch 270 may selectively connect the second state terminal 251*c* and the third state terminal 261*c*.

The switch 270 may be formed such that its state of electrical contact changes according to the detection result of rotation of the toner refill apparatus 400.

The switch 270 may include a pair of electrodes 271, 272. In an example, one of the pair of electrodes 271, 272 may be a fixed electrode, and the other electrode may be an elastic electrode that may elastically contact or be distanced from the fixed electrode.

The state of electrical contact of the pair of electrodes 271, 272 may change from an electrical open state to an electrical short state by an operation of the switch 270, when an inflow shutter (not shown) that rotates in association with rotation of the toner refill apparatus 400 mounted on the toner cartridge 200 reaches a specific position.

The toner refill apparatus 400 may include the fourth terminals 451*a*, 451*b*, 451*c* that are electrically connected to the third terminals 261*a*, 261*b*, 261*c*, respectively, of the toner cartridge 200.

On one side of the toner refill apparatus 400, the fourth terminals 451*a*, 451*b*, 451*c* which are three electrical contacts may be provided, and on a rear surface that is an opposite surface to the contact surface on which the fourth terminals 451*a*, 451*b*, 451*c* are formed, the circuit board 453 including a memory storing information on the toner refill apparatus 400 may be disposed.

The three third terminals 261*a*, 261*b*, 261*c* of the toner cartridge 200 may respectively correspond to the three fourth terminals 451*a*, 451*b*, 451*c* of the toner refill apparatus 400.

For example, the fourth state terminal 451*c* of the toner refill apparatus 400 may be electrically connected to the third state terminal 261*c* of the toner cartridge 200, and the fourth ground terminal 451*b* of the toner refill apparatus 400 may be electrically connected to the third ground terminal of the toner cartridge 200. Also, the fourth data terminal 451*a* of the toner refill apparatus 400 may be electrically connected to the third data terminal 261*a* of the toner cartridge 200.

The toner refill apparatus 400 may further include the first resistance R1 that is disposed between the fourth state terminal 451*c* and the fourth ground terminal 451*b*, the second resistance R2 that is disposed in parallel with the first resistance R1, and the fuse 440 that is connected with the second resistance R2 and is disposed on the fourth state terminal 451*c*.

The fuse 440 may be formed to be opened when a toner refill operation of the toner refill apparatus 400 is completed.

The fuse 440 may include a pair of electrodes 441, 442. In an example, one of the pair of electrodes 441, 442 may be a fixed electrode, and the other electrode may be an elastic electrode that may elastically be distanced from the fixed electrode.

The state of electrical contact of the pair of electrodes 441, 442 is such that, when the plunger 420 of the toner refill apparatus 400 reaches a specific position which corresponds to a state of completion of toner refill, the fuse 440 may electrically short connection of the fourth state terminal 451*c* connected with the second resistance R2.

The toner cartridge 200 may be electrically connected to the toner refill apparatus 400 mounted on the toner cartridge 200 and the main body 101, and may transmit information on the toner refill apparatus 400 and information on the toner cartridge 200 to the communication device 110 through the same interface.

Information on the toner refill apparatus 400 may include information on the connection state of the toner refill apparatus 400, and on the state of completion of toner refill of the toner refill apparatus 400.

Information on the toner refill apparatus 400 may include information for authentication of the toner refill apparatus 400, and information on the toner cartridge 200 may include information for authentication of the toner cartridge 200.

The communication device 110 may be connected to the toner refill apparatus 400 through the third terminals 261*a*, 261*b*, 261*c* and the second terminals 251*a*, 251*b*, 251*c* provided on the toner cartridge 200.

The communication device 110 may control the operation of an image forming apparatus, based on signals or information received through the first terminals 151*a*, 151*b*, 151*c*.

Each of the first terminal 151, the second terminal 251, the third terminal 261, and the fourth terminal 451 comprises a data terminal, a ground terminal, and a state terminal. Thus, areas of contacts between the toner refill apparatus 400 and the image forming apparatus 100 can be minimized. Accordingly, a problem of an electrical short between contacts that may occur in a structure comprising a plurality of contacts can be minimized. Also, by minimizing the number of contacts of the first terminal 151, the second terminal 251, the third terminal 261, and the fourth terminal 451, a possibility of defects in contacts can be reduced.

The image forming apparatus 100 may identify the connection state of the toner refill apparatus 400 and the state of completion of toner refill of the toner refill apparatus 400, etc. by using the state terminals 151*c*, 251*c*, 261*c*, and 451*c*.

Figure 8A:
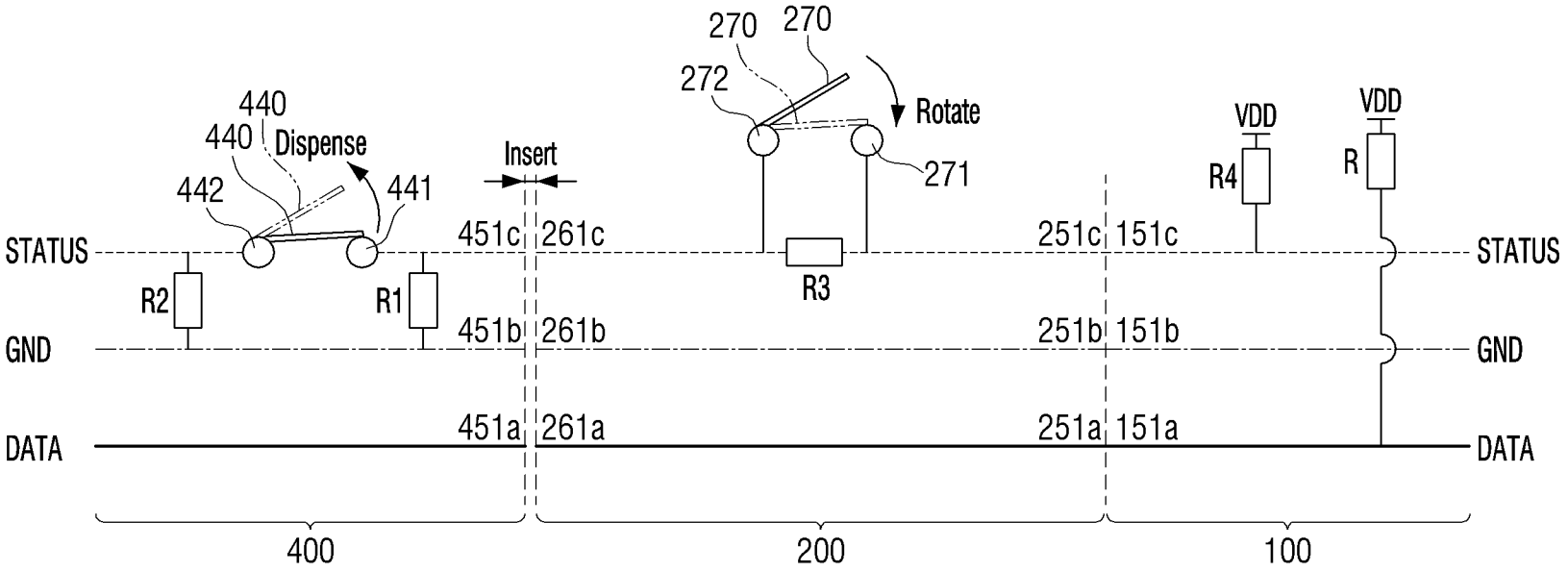
FIG. 8A is a diagram for illustrating a circuit structure of a toner refill apparatus, a toner cartridge, and a main body according to an example.

FIG. 8A is a diagram for illustrating a circuit structure of a toner refill apparatus, a toner cartridge, and a main body according to an example, and FIG. 8B is a table illustrating voltage values according to states of a toner refill apparatus according to an example.

Referring to FIGS. 8A and 8B, the image forming apparatus 100 may include an electrical structure for detecting whether the toner refill apparatus 400 is connected to the toner cartridge 200, and whether the toner refill apparatus 400 was used.

The communication device 110 of the image forming apparatus 100 may include the first terminals 151*a*, 151*b*, 151*c* that are electrically connected to the second terminals 251*a*, 251*b*, 251*c* of the toner cartridge 200 when the toner cartridge 200 is mounted on the main body 101, and the first state terminal 151*c* may be electrically connected to the second state terminal 251*c*.

Similarly, the toner cartridge 200 may include the third terminals 261*a*, 261*b*, 261*c* that are electrically connected to the fourth terminals 451*a*, 451*b*, 451*c* of the toner refill apparatus 400 when the toner refill apparatus 400 is connected to the toner cartridge 200. The third terminals 261*a*, 261*b*, 261*c* may be connected with the communication device 110 having the first terminals 151*a*, 151*b*, 151*c* through the second terminals 251*a*, 251*b*, 251*c*.

The communication device 110 may detect whether the toner refill apparatus 400 is connected to the toner cartridge 200 by detecting whether the fourth state terminal 451*c*, the third state terminal 261*c*, and the second state terminal 251*c* are electrically connected.

As an example, the communication device 110 may identify, based on a voltage value between the first state terminal 151*c* and the first ground terminal 151*b*, one of the first state wherein the toner refill apparatus 400 is not connected, the second state wherein the toner refill apparatus 400 is connected but the outlet 401 is closed, the third state wherein the outlet 401 of the toner refill apparatus 400 is opened, or the fourth state wherein the opened toner refill apparatus 400 completed refilling toner.

For example, in a case in which the toner refill apparatus 400 is not mounted on the toner cartridge 200, the third state terminal 261*c* and the fourth state terminal 451*c* are in an open state wherein they are not connected. Accordingly, a current does not flow in a circuit passing through the second state terminal 251*c*, and thus a first voltage value which is a reference voltage (VDD) is measured at the input port of the communication device 110 including a first state terminal 151*c* connected with the second state terminal 251*c*. For example, 3.3V which is a reference voltage (VDD) itself is applied.

When the toner refill apparatus 400 is mounted on the toner cartridge 200, the fourth state terminal 451*c* of the toner refill apparatus 400 may be electrically connected to the first state terminal 151*c* through the third state terminal 261*c* and the second state terminal 251*c* of the toner cartridge 200.

A determination of whether the toner refill apparatus 400 is mounted on the toner cartridge 200, i.e., whether the fourth terminals 451 and the third terminals 261 are connected, may be made based on a reference voltage (VDD), and a circuit including the first resistance R1 and the second resistance R2 that are disposed in parallel between the fourth state terminal 451*c* and the fourth ground terminal 451*b*, the third resistance R3 disposed on the second state terminal 251*c*, and the fourth resistance R4 formed on the first state terminal 151*c*.

In the case of the second state wherein the toner refill apparatus 400 is connected with the toner cartridge 200, a closed circuit may be formed. As an example, the closed circuit may include a circuit wherein the first and second resistances R1, R2 connected in parallel, the third resistance R3, and the fourth resistance R4 are connected in series.

In this case, a second voltage value may be measured at the input port of the communication device 110.

For example, in a case in which the resistance value of the first resistance R1 is 5KΩ, the resistance value of the second resistance R2 is 1KΩ, the resistance value of the third resistance R3 is 20KΩ, and the resistance value of the fourth resistance R4 is 10KΩ, 2.23V, which is a second voltage value, may be applied to the input port of the communication device 110.

That is, regarding a reference voltage (VDD) applied to the communication device 110, the communication device 110 may identify whether the toner refill apparatus 400 is mounted on the toner cartridge 200 based on the change of a voltage at the first state terminal 151*c* according to whether the toner refill apparatus 400 is mounted, and may control the image forming apparatus according to the detection result.

In a case in which the toner refill apparatus 400 is mounted on the toner cartridge 200, the fourth data terminal 451*a* of the toner refill apparatus 400 may be connected to the first data terminal 151*a* through the third data terminal 261*a* and the second data terminal 251*a*. The communication device 110 may read information on the toner refill apparatus 400 through the circuit board 453 provided on the toner refill apparatus 400. Information on the toner refill apparatus 400 may include information for authentication of the toner refill apparatus 400.

The toner cartridge 200 may include the switch 270 that detects that the toner refill apparatus 400 reached a specific position according to rotation of the toner refill apparatus 400 mounted on the toner cartridge 200. The toner cartridge 200 may transmit information on whether the mounted toner refill apparatus 400 reached a specific position according to rotation to the communication device 110 through the first state terminal 151*c*, based on an operation of the switch 270.

For example, the contact state of the switch 270 may be changed when the toner refill apparatus 400 reaches a specific position as one component provided on the toner cartridge 200 rotates in association with rotation of the toner refill apparatus 400.

For example, in the case of the second state wherein the toner refill apparatus 400 is connected to the toner cartridge 200, but the outlet 401 is closed, the switch 270 may be in an electrical open state. In this case, as in the state wherein the toner refill apparatus 400 is mounted on the toner cartridge 200 reviewed above, a voltage of 2.23V which is a second voltage value may be applied to the input port of the communication device 110.

In the case of the third state wherein the outlet 401 of the toner refill apparatus 400 is opened according to rotation of the toner refill apparatus 400, the switch 270 may be in an electrical short state.

In this case, a determination of whether a state is the third state may be made based on a reference voltage (VDD) and a circuit including the first resistance R1, the second resistance R2, and the fourth resistance R4. In the case of the third state wherein the outlet of the toner refill apparatus 400 is opened, a circuit passing through the first state terminal 151*c* may be a circuit wherein the first and second resistances R1, R2 connected in parallel, and the fourth resistance R4 are connected in series.

In a case in which the toner refill apparatus 400 mounted on the toner cartridge 200 rotates, the state of electrical contact of the switch 270 provided on the toner cartridge 200 may be changed from an open state to an electrical short state, and accordingly, a third voltage may be measured at the input port of the communication device 110.

As described above, in a case in which the reference voltage applied to the communication device 110 is 3.3V, and the resistance value of the first resistance R1 is 5KΩ, the resistance value of the second resistance R2 is 1KΩ, the resistance value of the third resistance R3 is 20KΩ, and the resistance value of the fourth resistance R4 is 10KΩ, a voltage of 0.25V may be applied to the input port of the communication device 110.

Accordingly, regarding a reference voltage VDD applied to the communication device 110, the communication device 110 may detect whether the toner refill apparatus 400 rotates based on the change of a voltage at the first state terminal 151*c*, and may control the image forming apparatus according to the detection result.

When the state of the toner refill apparatus 400 becomes a state wherein the toner refill apparatus 400 is rotated, and toner accommodated in the toner refill apparatus 400 can be infiltrated into the toner accommodating part of the toner cartridge 200, the user may press the plunger 420, and thereby fill the toner accommodating part with toner through the toner cartridge 200.

Whether infiltration of toner has been completed may be detected by the toner infiltration completion fuse 440. In the case of the fourth state wherein the plunger 420 completed refilling toner, a pressing projection 445 may push the operation lever 443, and thereby cause the pair of electrodes 441, 442 to be distanced from each other. One of the pair of electrodes 441, 442 may be a fixed electrode, and the other electrode may be an elastic electrode that may elastically be distanced from the fixed electrode.

Here, in a case in which infiltration of toner from the toner refill apparatus 400 is completed, the state of electrical contact of the fuse 440 provided on the toner refill apparatus 400 may be changed from an electrical short state to an open state, and a fourth voltage value of the communication device 110 may be measured.

In this case, whether the state is the fourth state may be identified by a reference voltage (VDD) and a circuit including the first resistance R1 and the fourth resistance R4. In the case of the fourth state wherein infiltration of toner from the toner refill apparatus 400 is completed, a circuit passing through the first state terminal 151*c* may be a circuit wherein the first resistance R1 and the fourth resistance R4 are connected in series.

For example, as described above, in a case in which the reference voltage applied to the communication device 110 is 3.3V, and the resistance value of the first resistance R1 is 5KΩ, the resistance value of the second resistance R2 is 1KΩ, the resistance value of the third resistance R3 is 20KΩ, and the resistance value of the fourth resistance R4 is 10KΩ, a voltage of 1.1V may be applied to the input port of the communication device 110.

Accordingly, regarding a reference voltage VDD applied to the communication device 110, the communication device 110 may detect whether the toner refill apparatus 400 was used based on the change of a voltage flowing through the first state terminal 151*c* according to whether refill of toner from the toner refill apparatus 400 is completed, and may control the image forming apparatus according to the detection result.

For detachment of the toner refill apparatus 400 that completed refill of toner, the toner refill apparatus 400 may be rotated in an opposite direction to the direction of rotation of the toner refill apparatus 400 after it was mounted on the toner cartridge 200. Accordingly, an inflow shutter (not shown) that rotated in association with rotation of the toner refill apparatus 400 may be restored to its original position.

When infiltration of toner from the toner refill apparatus 400 is completed, and a lock of the toner refill apparatus 400 is released as the toner refill apparatus 400 is rotated in an opposite direction to the direction of rotation of the toner refill apparatus 400 after it was mounted on the toner cartridge 200, the user may separate the toner refill apparatus 400 from the toner cartridge 200. Accordingly, a signal of 3.3V may be input again to the input port of the communication device 110.

The image forming apparatus 100 may identify a state wherein the toner refill apparatus 400 that was used at least once is connected to the image forming apparatus 100 as the fifth state, in order to prevent reuse of the toner refill apparatus 400.

The fuse 440 of the toner refill apparatus 400 is opened based on use of the toner refill apparatus 400. Accordingly, in the case of the fifth state wherein the toner refill apparatus 400 used once is connected to the image forming apparatus 100, a fifth voltage value may be applied to the input port of the communication device 110.

In this case, the second resistance R2 does not influence the measured voltage value, due to opening of the fuse 440. Whether the toner refill apparatus 400 is in the fifth state may be identified by a reference voltage VDD and a circuit including the first resistance R1, the third resistance R3, and the fourth resistance R4. A circuit passing through the first state terminal 151*c* may be a circuit wherein the first resistance R1, the third resistance R3, and the fourth resistance R4 are connected in series.

As described above, in a case in which the reference voltage applied to the communication device 110 is 3.3V, and the resistance value of the first resistance R1 is 5KΩ, the resistance value of the third resistance R3 is 20KΩ, and the resistance value of the fourth resistance R4 is 10KΩ, a voltage of 2.36V which is a fifth voltage value may be applied to the input port of the communication device 110.

Figure 9:
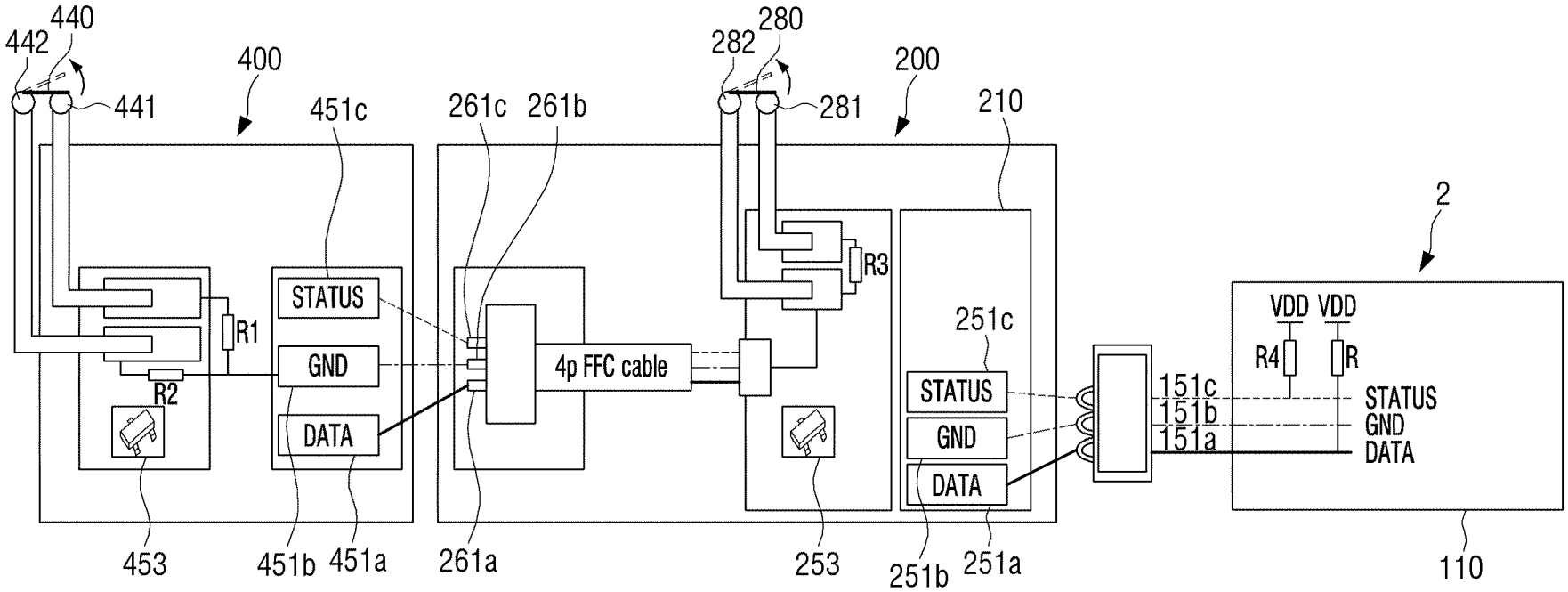
FIG. 9 is a diagram for illustrating a schematic connection structure among a toner refill apparatus, a toner cartridge, and a main body according to an example.
Figure 10A:
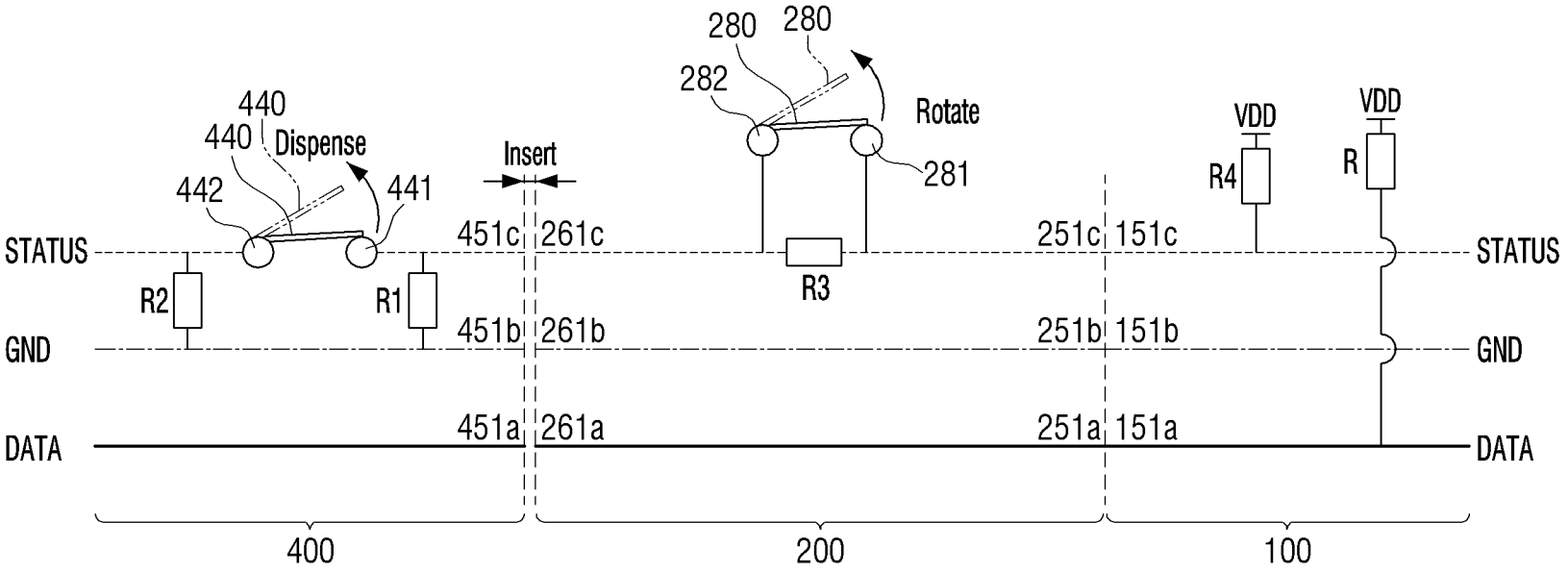
FIG. 10A is a diagram for illustrating a circuit structure of a toner refill apparatus, a toner cartridge, and a main body according to an example.

FIG. 9 is a diagram for illustrating a schematic connection structure among a toner refill apparatus, a toner cartridge, and a main body according to an example. FIG. 10A is a diagram for illustrating a circuit structure of a toner refill apparatus, a toner cartridge, and a main body according to an example. FIG. 10B is a table illustrating voltage values according to the states of a toner refill apparatus according to an example.

Referring to FIGS. 9, 10A, and 10B, an image forming apparatus 2 is illustrated. In the example of FIGS. 9, 10A, and 10B, most of the components of the image forming apparatus 2 are substantially identical to the components of the image forming apparatus 100 illustrated in FIGS. 7 and 8. However, there are differences in the operation method of a switch 280 included in the toner cartridge 200, the resistance value of the third resistance R3, and the resistance value of the first resistance R1 of the toner refill apparatus 400. Accordingly, regarding the image forming apparatus 2, an explanation of the components that overlap with the components of the image forming apparatus 100 illustrated in FIGS. 7 and 8 will be omitted.

In the example of FIGS. 9, 10A, and 10B, the toner cartridge 200 may include a third state terminal 261*c*, a third resistance R3 disposed between the third state terminal 261*c*, and the switch 280 that is disposed in parallel with the third resistance R3 and selectively connects the second state terminal 251*c* and the third state terminal 261*c*.

The switch 280 is formed such that its state of electrical contact is changed according to the detection result of rotation of the toner refill apparatus 400, and the switch 280 may include a pair of electrodes 281, 282.

One of the pair of electrodes 281, 282 may be a fixed electrode, and the other electrode may be an elastic electrode that may elastically contact or be distanced from the fixed electrode.

The state of electrical contact of the pair of electrodes 281, 282 may change from an electrical short state to an electrical open state by an operation of the switch 280, when a component that rotates in association with rotation of the toner refill apparatus 400 mounted on the toner cartridge 200 reaches a specific position.

The resistance value of the third resistance R3 may be formed as 5KΩ. In this case, the reference voltage applied to the communication device 110 may be formed as 3.3V, and the resistance value of the first resistance R1 as 20KΩ, the resistance value of the second resistance R2 as 1KΩ, the resistance value of the third resistance R3 as 5KΩ, and the resistance value of the fourth resistance R4 as 10KΩ.

In the case of the first state wherein the toner refill apparatus 400 is not connected, the third state terminal 261*c* and the fourth state terminal 451*c* are in an open state wherein they are not connected. Accordingly, a current does not flow in a circuit passing through the second state terminal 251*c*, and thus a first voltage value which is a reference voltage (VDD) may be specified at the input port of the communication device 110 having a first state terminal 151*c* connected with the second state terminal 251*c*. For example, 3.3V is applied to the input port of the communication device 110.

In the case of the second state wherein the toner refill apparatus 400 is connected, but the outlet 401 is closed, the switch 280 is in an electrical short state. In this case, whether the state is the second state may be identified by a reference voltage (VDD) and a circuit including the first resistance R1, the second resistance R2, and the fourth resistance R4. Also, in the case of the second state wherein the outlet of the toner refill apparatus 400 is closed, a circuit passing through the first state terminal 151*c* may be a circuit wherein the first and second resistances R1, R2 connected in parallel, and the fourth resistance R4 are connected in series. Here, a voltage of 0.29V, for example, which is a second voltage value may be applied to the input port of the communication device 110.

In the case of the third state wherein the outlet 401 of the toner refill apparatus 400 is opened, if the toner refill apparatus 400 mounted on the toner cartridge 200 rotates, the state of electrical contact of the switch 280 provided on the toner cartridge 200 may be changed from a short state to an open state. In this case, a circuit passing through the first state terminal 151*c* may be a circuit wherein the first and second resistances R1, R2 connected in parallel, the third resistance R3, and the fourth resistance R4 are connected in series. Also, a voltage of 1.23V, for example, which is a third voltage value may be applied to the input port of the communication device 110.

In the case of the fourth state wherein the opened toner refill apparatus 400 completed refilling toner, the fuse 440 provided on the toner refill apparatus 400 is opened, and the state of electrical contact is changed. Accordingly, a voltage of 2.36V, for example, which is a fourth voltage value may be applied to the input port of the communication device 110.

The image forming apparatus 2 may determine a state wherein the toner refill apparatus 400 that was used at least once is connected to the image forming apparatus 2 as the fifth state, in order to prevent reuse of the toner refill apparatus 400.

The fuse 440 of the toner refill apparatus 400 is opened by use. Accordingly, in the case of the fifth state wherein the toner refill apparatus 400 used once is connected to the image forming apparatus 2, a fifth voltage value may be applied to the input port of the communication device 110.

In this case, the second resistance R2 does not influence the measured voltage value, due to opening of the fuse 440. Also, as the initial state of the switch 280 of the toner cartridge 200 is an electrical short state, whether the state is the fifth state may be identified by a reference voltage (VDD), and a circuit wherein the first resistance R1 and the fourth resistance R4 are connected in series.

As described above, in a case in which the reference voltage applied to the communication device 110 is 3.3V, the resistance value of the first resistance R1 is 20KΩ, and the resistance value of the fourth resistance R4 is 10KΩ, a voltage of 2.2V which is a fifth voltage value may be applied to the input port of the communication device 110.

Figure 11:
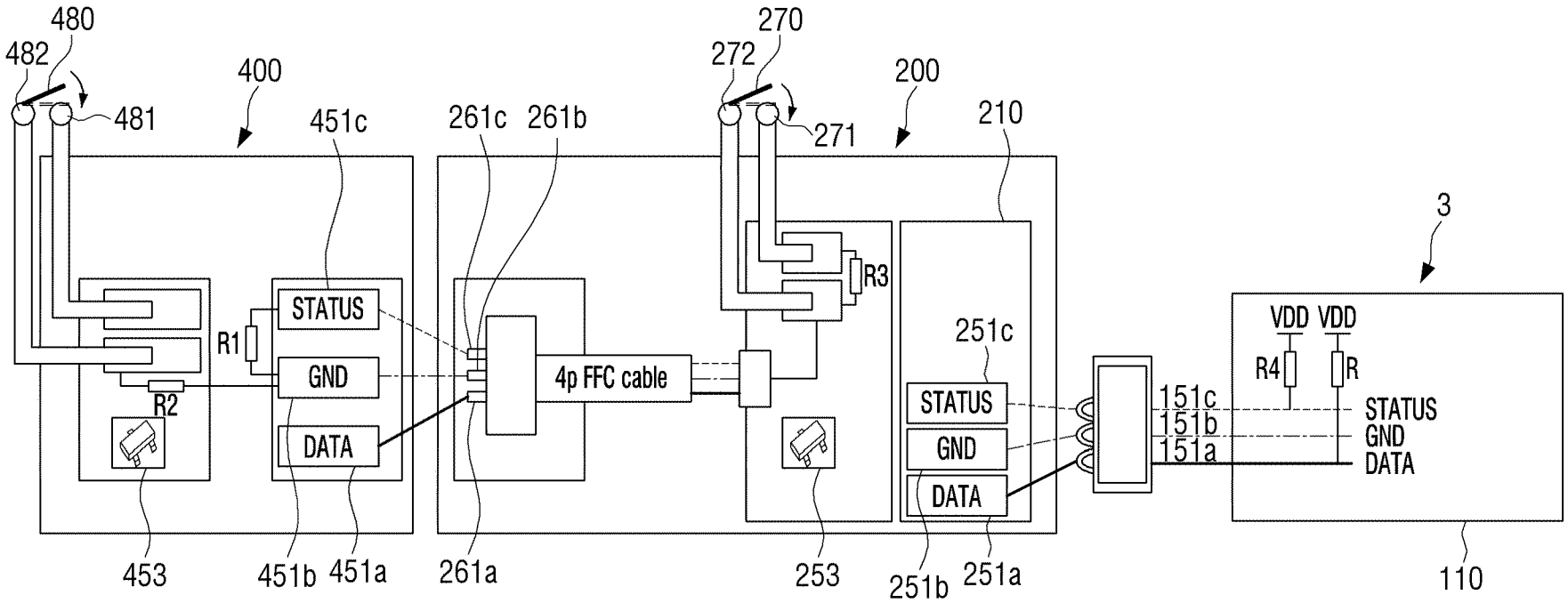
FIG. 11 is a diagram for illustrating a schematic connection structure among a toner refill apparatus, a toner cartridge, and a main body according to an example.
Figure 12A:
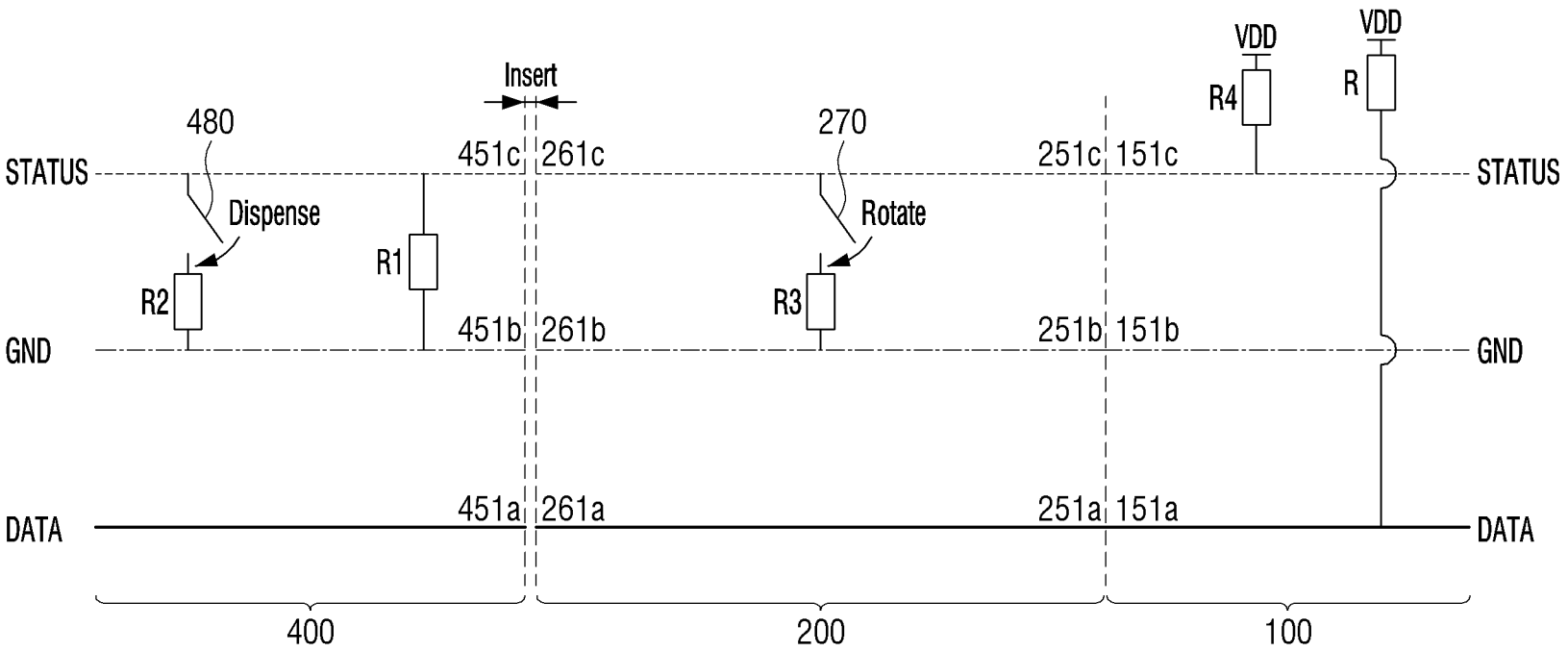
FIG. 12A is a diagram for illustrating a circuit structure of a toner refill apparatus, a toner cartridge, and a main body according to an example.

FIG. 11 is a diagram for illustrating a schematic connection structure among a toner refill apparatus, a toner cartridge, and a main body according to an example. FIG. 12A is a diagram for illustrating a circuit structure of a toner refill apparatus, a toner cartridge, and a main body according to an example. FIG. 12B is a table illustrating voltage values according to the states of a toner refill apparatus according to an example.

Referring to FIGS. 11, 12A, and 12B, an image forming apparatus 3 is illustrated. In the example of FIGS. 11, 12A, and 12B, most of the components of the image forming apparatus 3 are substantially identical to the components of the image forming apparatus 2 illustrated in FIGS. 9, 10A, and 10B. However, there are differences in the resistance value of the third resistance R3 of the toner cartridge 200, the arrangement of the switch 270, and the operation method of a fuse 480 included in the toner refill apparatus 400. Accordingly, regarding the image forming apparatus 3, an explanation of the components that overlap with the components of the image forming apparatus 2 illustrated in FIGS. 9, 10A, and 10B will be omitted.

The toner cartridge 200 may include the third resistance R3 disposed between the third state terminal 261*c* and the third ground terminal 261*b*, and the switch 270 that is disposed in series with the third resistance R3 and selectively connects the third resistance R3.

The switch 270 is formed such that its state of electrical contact is changed according to the detection result of rotation of the toner refill apparatus 400, and the switch 270 may include a pair of electrodes 271, 272.

In an example, one of the pair of electrodes 271, 272 may be a fixed electrode, and the other electrode may be an elastic electrode that may elastically contact or be distanced from the fixed electrode.

The state of electrical contact of the pair electrodes 271, 272 may change from an electrical open state to an electrical short state according to an operation of the switch 270.

The resistance value of the third resistance R3 may be formed as 10KΩ. In this case, the reference voltage applied to the communication device 110 may be formed as 3.3V, the resistance value of the first resistance R1 as 20KΩ, the resistance value of the second resistance R2 as 1KΩ, the resistance value of the third resistance R3 as 10KΩ, and the resistance value of the fourth resistance R4 as 10KΩ.

In the case of the first state wherein the toner refill apparatus 400 is not connected, the third state terminal 261*c* and the fourth state terminal 451*c* are in an open state wherein they are not connected. Accordingly, a current does not flow in a circuit passing through the second state terminal 251*c*, and thus a first voltage value which is a reference voltage (VDD), for example, 3.3V is applied to the input port of the communication device 110 having a first state terminal 151*c* connected with the second state terminal 251*c*.

In the case of the second state wherein the toner refill apparatus 400 is connected, but the outlet 401 is closed, the switch 270 is in an electrical open state. In this case, whether the state is the second state may be identified by a reference voltage (VDD) and a circuit including the first resistance R1, the second resistance R2, and the fourth resistance R4. Also, in the case of the second state wherein the outlet 401 of the toner refill apparatus 400 is closed, a circuit passing through the first state terminal 151*c* may be a circuit wherein the first and second resistances R1, R2 connected in parallel, and the fourth resistance R4 are connected in series. Here, a voltage of 0.22V, for example, which is a second voltage value may be applied to the input port of the communication device 110.

In the case of the third state wherein the outlet 401 of the toner refill apparatus 400 is opened, if the toner refill apparatus 400 mounted on the toner cartridge 200 rotates, the state of electrical contact of the switch 270 provided on the toner cartridge 200 may be changed from an open state to a short state. In this case, a circuit passing through the first state terminal 151*c* may be a circuit including the first and second resistances R1, R2 connected in parallel, the third resistance R3 connected in parallel, and the fourth resistance R4 connected in series. Also, a voltage of 1.32V, for example, which is a third voltage value may be applied to the input port of the communication device 110.

In an example, the fuse 480 may be formed such that it is shorted when a toner refill operation of the toner refill apparatus 400 is completed.

The fuse 480 may include a pair of electrodes 481, 482. One of the pair of electrodes 481, 482 may be a fixed electrode, and the other electrode may be an elastic electrode that may elastically be distanced from the fixed electrode.

The state of electrical contact of the pair of electrodes 481, 482 is such that, when the plunger 420 of the toner refill apparatus 400 reaches a specific position which corresponds to a state of completion of toner refill, the fuse 480 may electrically short connection of the fourth state terminal 451*c* connected with the second resistance R2.

In the case of the fourth state wherein the opened toner refill apparatus 400 completed refilling toner, the state of electrical contact of the fuse 480 provided on the toner refill apparatus 400 may be changed from an open state to an electrical short state. Accordingly, a voltage of 0.26V, for example, which is a fourth voltage value may be applied to the input port of the communication device 110.

The image forming apparatus 3 may identify a state wherein the toner refill apparatus 400 that was used at least once is connected to the image forming apparatus 3 as the fifth state, in order to prevent reuse of the toner refill apparatus 400.

The fuse 480 of the toner refill apparatus 400 is shorted by use. Accordingly, in the case of the fifth state wherein the toner refill apparatus 400 used once is connected to the image forming apparatus 3, a fifth voltage value may be applied to the input port of the communication device 110.

In this case, due to the short of the fuse 480, a resistance wherein the first resistance R1 and the second resistance R2 are connected in parallel influences the measured voltage value. As the initial state of the switch 270 of the toner cartridge 200 is an electrical open state, the third resistance R3 does not influence the measured voltage value.

Whether the state of the toner refill apparatus 400 is a fifth state may be identified by a reference voltage (VDD) and a circuit including the first resistance R1, the second resistance R2, and the fourth resistance R4. A circuit passing through the first state terminal 151*c* may comprise the first and second resistances R1, R2 connected in parallel, and the fourth resistance R4 connected in series.

As described above, in a case in which the reference voltage applied to the communication device 110 is 3.3V, and the resistance value of the first resistance R1 is 20KΩ, the resistance value of the second resistance R2 is 1KΩ, and the resistance value of the fourth resistance R4 is 10KΩ, a voltage of 0.28V may be applied to the input port of the communication device 110.

While the disclosure has been shown and described with reference to examples thereof, the disclosure is not limited to the aforementioned examples, and it is apparent that various modifications can be made by those having ordinary skill in the technical field to which the disclosure belongs, without departing from the gist of the disclosure as claimed by the appended claims, and such modifications are within the scope of the descriptions of the claims.

The invention claimed is:

1. An image forming apparatus comprising:

a printing engine to perform a printing work by using toner in a toner cartridge;

a communication device to communicate with a circuit board attached to a toner refill apparatus that is to refill toner in the toner cartridge by using a plurality of terminals, the plurality of terminals of the communication device including a first ground terminal, a first data terminal, and a first state terminal, and; and a processor to identify a connection state of the toner refill apparatus based on a voltage value of at least one of the plurality of terminals, wherein the toner refill apparatus comprises a fourth ground terminal, a fourth data terminal, a fourth state terminal, a first resistance disposed between the fourth ground terminal and the fourth state terminal, a second resistance of which one end is commonly connected to one end of the first resistance and the fourth ground terminal, and a fuse of which one end is connected to the other end of the second resistance, and of which another end is connected to the fourth state terminal.

2. The image forming apparatus of claim 1, wherein the processor is to identify the connection state of the toner refill apparatus and whether the toner refill apparatus was used based on a voltage value between the first state terminal and the first ground terminal.

3. The image forming apparatus of claim 1, wherein the fuse is to open when based on a refill operation of the toner refill apparatus being completed.

4. The image forming apparatus of claim 1, wherein the processor is to identify whether the toner refill apparatus is available based on the voltage value.

5. The image forming apparatus of claim 1, wherein the processor is to identify, based on the at least one voltage value, one of a first state wherein the toner refill apparatus is not connected, a second state wherein the toner refill apparatus is connected but an outlet from which toner is discharged is closed, a third state wherein the outlet of the toner refill apparatus is opened, or a fourth state wherein the opened toner refill apparatus completed refilling toner.

6. The image forming apparatus of claim 1, wherein the toner cartridge comprises:

a plurality of second terminals that are connected to each of the plurality of terminals of the communication device;

a plurality of third terminals that are connected to each of a plurality of terminals of the toner refill apparatus;

a third resistance that is disposed between a second state terminal among the plurality of second terminals and a third state terminal among the plurality of third terminals; and a switch that is disposed in parallel with the third resistance to selectively connect the second state terminal and the third state terminal.

7. The image forming apparatus of claim 6, wherein the switch is to connect, based on the toner cartridge being rotatively mounted on the toner refill apparatus, the second state terminal and the third state terminal.

8. A toner refill apparatus comprising:

a toner outlet to couple to an external pass-through opening of an image forming apparatus to supply toner to a toner cartridge of the image forming apparatus;

a bottle to contain toner;

a circuit board disposed on the bottle, to store apparatus information and use history information of the toner refill apparatus;

a plurality of terminals to communicate with a communication device of an image forming apparatus; and a circuit member to vary, based on infiltration of toner contained in the bottle being completed, a resistance value between a first terminal and a second terminal among the plurality of terminals.

9. The toner refill apparatus of claim 8, wherein the circuit member comprises:

a first resistance that is disposed between a ground terminal and a state terminal;

a second resistance of which one end is commonly connected to one end of the first resistance and the ground terminal; and a fuse of which one end is connected to the other end of the second resistance, and of which another end is connected to the state terminal.

10. The toner refill apparatus of claim 9, wherein the fuse is to open based on infiltration of the toner being completed.

11. The toner refill apparatus of claim 8, further comprising a discharge shutter to selectively open and close the toner outlet.

12. The toner refill apparatus of claim 11, wherein the discharge shutter is to rotate to selectively open and close the toner outlet.

13. The toner refill apparatus of claim 12, wherein the discharge shutter is to rotate by 180° to selectively open and close the toner outlet and wherein the discharge shutter is to rotate about a center axis of the toner refill apparatus.

14. The toner refill apparatus of claim 8, further comprising:

an inner body;

an outer body disposed on an outside of the inner body; and a plunger to be movably inserted into the inner body.

15. A circuit structure of a toner refill device, the circuit structure comprising:

a memory to store data;

a data terminal coupled to the memory;

a ground terminal; and a state terminal, wherein the memory is located on a first surface of a toner outlet of the toner refill device, the toner outlet to couple to a toner cartridge of an image forming apparatus, and wherein the data terminal, the ground terminal, and the state terminal are located on a second surface of the toner outlet that is opposite to the first surface.

16. The circuit structure of claim 15, further comprising a first resistor coupled to the state terminal and the ground terminal.

17. The circuit structure of claim 16, further comprising a second resistor coupled to the ground terminal and conditionally coupled to the state terminal.

* * * * *